US009502836B2

(12) United States Patent
Hashiguchi

(10) Patent No.: US 9,502,836 B2
(45) Date of Patent: Nov. 22, 2016

(54) SOCKET CONTACT, INTER-CONNECTOR AND CONNECTOR DEVICE

(71) Applicant: JAPAN AVIATION ELECTRONICS INDUSTRY, LIMITED, Shibuya-ku, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/843,653

(22) Filed: Sep. 2, 2015

(65) Prior Publication Data

US 2016/0141784 A1 May 19, 2016

(30) Foreign Application Priority Data

Nov. 14, 2014 (JP) ..... 2014-231492

(51) Int. Cl.

| | |
|---|---|
| ***H01R 13/11*** | (2006.01) |
| ***H01R 31/06*** | (2006.01) |
| ***H01R 24/50*** | (2011.01) |
| ***H01R 12/73*** | (2011.01) |
| *H01R 103/00* | (2006.01) |

(52) U.S. Cl.

CPC ..... *H01R 24/50* (2013.01); *H01R 12/73* (2013.01); *H01R 2103/00* (2013.01)

(58) Field of Classification Search

CPC .... H01R 24/542; H01R 24/50; H01R 24/54; H01R 13/11–13/115; H01R 31/06

See application file for complete search history.

(56) References Cited

U.S. PATENT DOCUMENTS 3,955,869 A * 5/1976 Licht ..... H01R 13/114 439/218
3,990,766 A * 11/1976 Volinskie ..... H01R 13/648 439/442
5,024,627 A * 6/1991 Bennett ..... H01R 12/721 439/247
5,676,570 A * 10/1997 Scherer ..... H01R 13/052 439/787
6,227,868 B1 * 5/2001 Wlodarski ..... H01R 24/40 439/63
6,497,579 B1 * 12/2002 Garbini ..... H01R 13/6315 439/246
6,595,799 B2 * 7/2003 Yao ..... H01R 24/44 439/578
7,112,078 B2 * 9/2006 Czikora ..... H01R 13/6315 439/248
7,484,965 B2 * 2/2009 Chien ..... H01R 24/50 439/63
8,105,092 B2 * 1/2012 Weidner ..... H01R 24/50 439/581
8,801,459 B2 * 8/2014 Mrowka ..... H01R 24/54 439/246
2002/0022413 A1 * 2/2002 Yeh ..... H01R 31/06 439/857
2007/0026698 A1 * 2/2007 Rosenberger ..... H01R 13/2464 439/63

FOREIGN PATENT DOCUMENTS

| | | |
|---|---|---|
| JP | 2000215956 A | 8/2000 |
| JP | 2012195299 A | 10/2012 |
| JP | 2013171739 A | 9/2013 |

* cited by examiner

*Primary Examiner* — Gary Paumen
(74) *Attorney, Agent, or Firm* — Holtz, Holtz & Volek PC

(57) ABSTRACT

A socket contact is connectable with a first terminal and a second terminal at opposite ends thereof in an axial direction, respectively. The socket contact comprises a first portion, a second portion and a coupling portion. The first portion has a first end, a second end and a first spring portion. The first end includes a first contact point which is to be connected to the first terminal. The second end includes a second contact point which is to be connected to the second terminal. The first spring portion is positioned between the first contact point and the second contact point. The second portion has a third end, a fourth end and a second spring portion. The third end includes a third contact point which is to be connected to the first terminal. The fourth end includes a fourth contact point which is to be connected to the second terminal. The second spring portion is positioned between the third contact point and the fourth contact point. The coupling portion couples the first end with the fourth end.

19 Claims, 14 Drawing Sheets

SOCKET CONTACT, INTER-CONNECTOR AND CONNECTOR DEVICE

CROSS REFERENCE TO RELATED APPLICATIONS

An applicant claims priority under 35 U.S.C. §119 of Japanese Patent Application No. JP 2014-231492 filed Nov. 14, 2014.

BACKGROUND OF THE INVENTION

This invention relates to a connector device suitable for a connection between circuit boards, especially to a socket contact of an inter-connector which is included in the connector device.

As shown in FIG. 24, JP-A 2000-215956 (Patent Document 1) discloses a connector device 900 which comprises a first connector 910, a second connector 920 and an inter-connector 930. The first connector 910 is fixed to a mother board 940. The first connector 910 comprises a first terminal 915. The second connector 920 is fixed to a daughter board 950. The second connector 920 comprises a second terminal 925. The inter-connector 930 is mated with and held by the first connector 910. The inter-connector 930 comprises a socket contact 935. The socket contact 935 is connected with the first terminal 915 at one end thereof. The socket contact 935 is connected with the second terminal 925 at the other end thereof. The second connector 920 and the inter-connector 930 can be mated with and removed from each other along an axial direction.

SUMMARY OF THE INVENTION

It is an object of the present invention to provide a connector device having a structure which enables a secure connection of circuit boards even in a case where a distance therebetween is short, and to provide an inter-connector and a socket contact which are usable for the connector device.

One aspect (first aspect) of the present invention provides a socket contact connectable with a first terminal and a second terminal at opposite ends thereof in an axial direction, respectively. The socket contact comprises a first portion, a second portion and a coupling portion. The first portion has a first end, a second end and a first spring portion. The first end includes a first contact point which is to be connected to the first terminal. The second end includes a second contact point which is to be connected to the second terminal. The first spring portion is positioned between the first contact point and the second contact point. The second portion has a third end, a fourth end and a second spring portion. The third end includes a third contact point which is to be connected to the first terminal. The fourth end includes a fourth contact point which is to be connected to the second terminal. The second spring portion is positioned between the third contact point and the fourth contact point. The coupling portion couples the first end with the fourth end.

Another aspect (second aspect) of the present invention provides an inter-connector comprising the socket contact of the first aspect and a holding member which accommodates, at least in part, the socket contact to hold it.

Still another aspect (third aspect) of the present invention provides a connector device comprising the inter-connector of the second aspect, a first connector and a second connector. The first connector comprises the first terminal and a first outer conductor. The first terminal functions as a first center conductor. The first outer conductor is positioned away from the first center conductor in a radial direction perpendicular the axial direction. The second connector comprises the second terminal and a second outer conductor. The second terminal functions as a second center conductor. The second outer conductor is positioned away from the second center conductor in the radial direction. The inter-connector is to be mated with the first connector and the second connector at opposite ends thereof in the axial direction, respectively. The inter-connector further comprises an outer contact. The holding member insulates the socket contact and the outer contact from each other. The outer contact has an outer first end, an outer second end and an outer main portion. The outer first end and the outer second end are positioned away from each other in the axial direction. The outer first end and the outer second end are to be connected with the first outer conductor and the second outer conductor, respectively. The outer main portion couples the outer first end with the outer second end. The outer contact is formed with a plurality of first slits and a plurality of second slits. Each of the first slits extends from the outer first end toward the outer second end while not reaching the outer second end. Each of the second slits extends from the outer second end toward the outer first end while not reaching the outer first end. The first slits and the second slits are alternately arranged in a circumferential direction around the axial direction. The first slits are positioned at first positions, respectively, in the axial direction. The second slits are positioned at second positions, respectively, in the axial direction. Each of the first positions and each of the second positions overlap with each other.

Since the coupling portion couples the first end of the first portion with the fourth end, which is positioned far away from the first end of the first portion in the axial direction, of the second portion, sizes of the first spring portion and the second spring portion in the axial direction can be increased. Accordingly, the socket contact can have sufficient spring force even in a case where a distance between circuit boards is short. Thus, the first terminal of a first object, or the first connector, and the second terminal of a second object, or the second connector, can be securely connected with each other by the socket contact.

Figure 1:
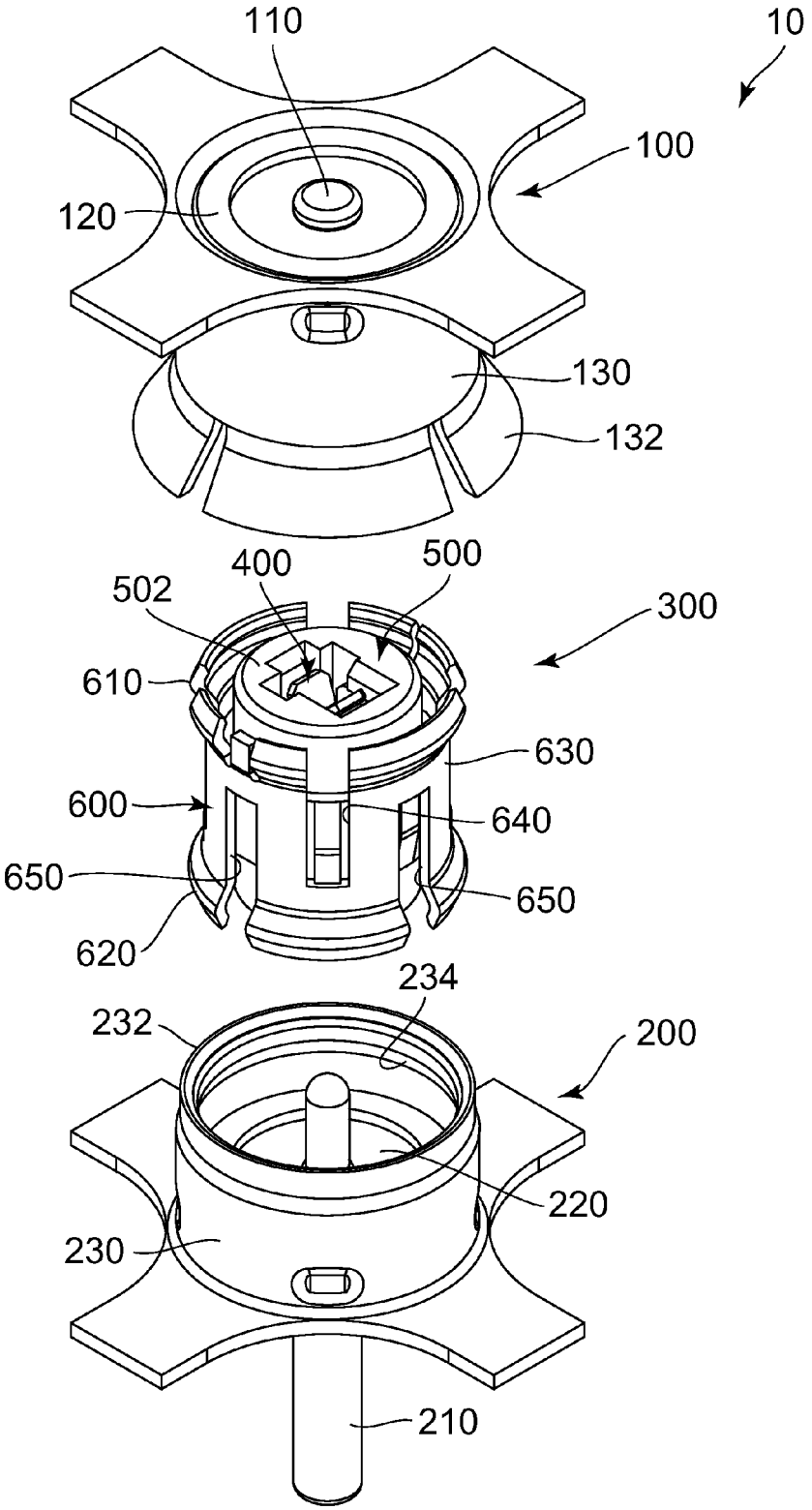
FIG. 1 is a perspective view showing a connector device comprising a first connector, a second connector and an inter-connector according to an embodiment of the present invention. The first connector, the second connector and the inter-connector are not yet mated with each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
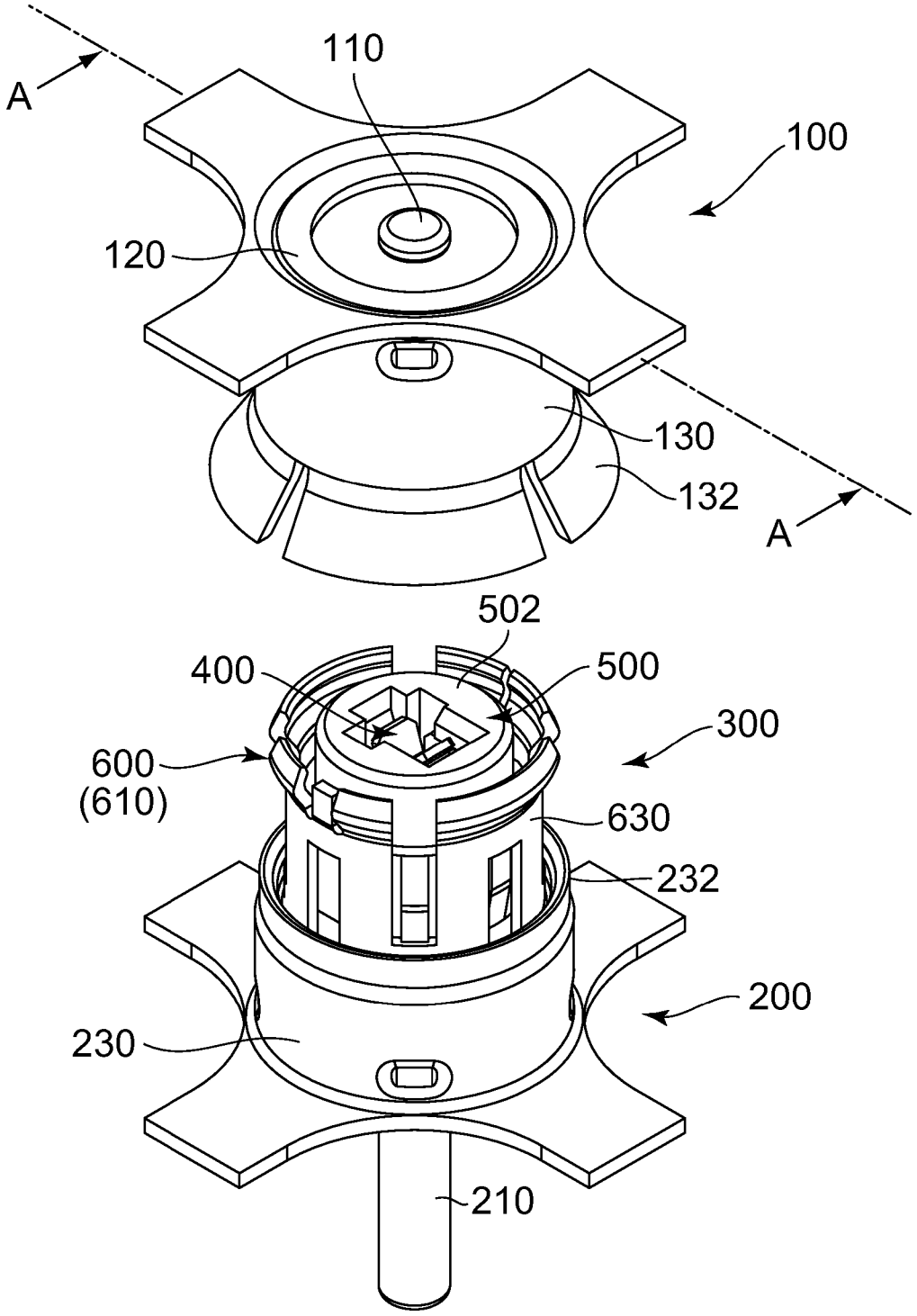
FIG. 2 is a perspective view showing the connector device of FIG. 1. The inter-connector is attached to the second connector. The first connector is not yet mated with the inter-connector.
Figure 3:
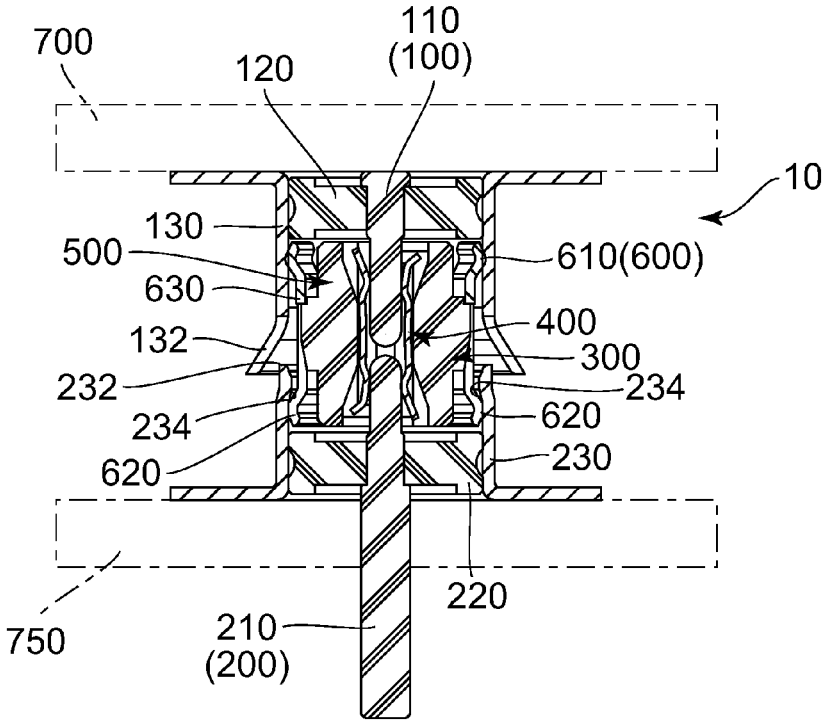
FIG. 3 is a cross-sectional view showing the connector device of FIG. 2, taken along line A-A.

With reference to FIGS. 1 and 2, a connector device 10 according to an embodiment of the present invention comprises a first connector 100, a second connector 200 and an inter-connector 300. The inter-connector 300 is mated with the first connector 100 and the second connector 200 at opposite ends thereof in an axial direction, respectively. Under actual use condition, the inter-connector 300 is mated with the second connector 200 to be attached thereto while only the first connector 100 is mated with and removed from the inter-connector 300 along the axial direction. As shown in FIG. 3, the first connector 100 is to be fixed to a first circuit board 700, and the second connector 200 is to be fixed to a second circuit board 750 which is different from the first circuit board 700. Specifically, the first connector 100 is a surface mount connector, and the second connector 200 is a through-hole connector.

Figure 4:
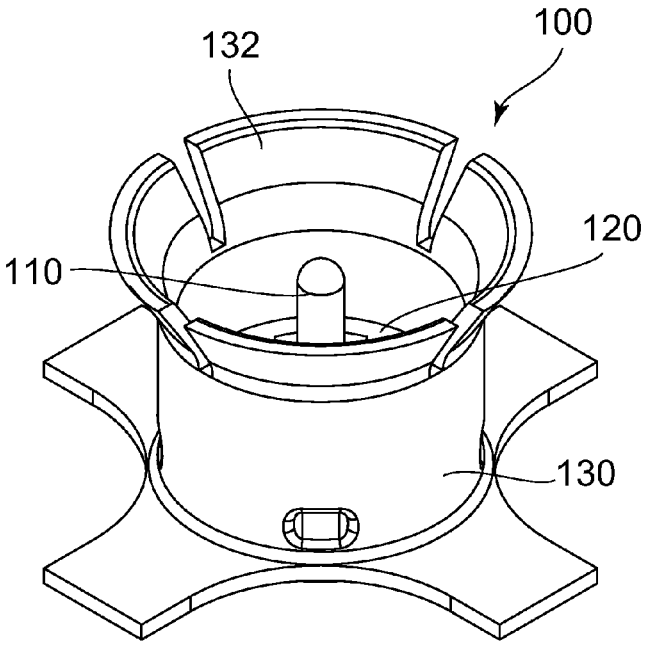
FIG. 4 is a perspective view showing the first connector of FIG. 1.
Figure 5:
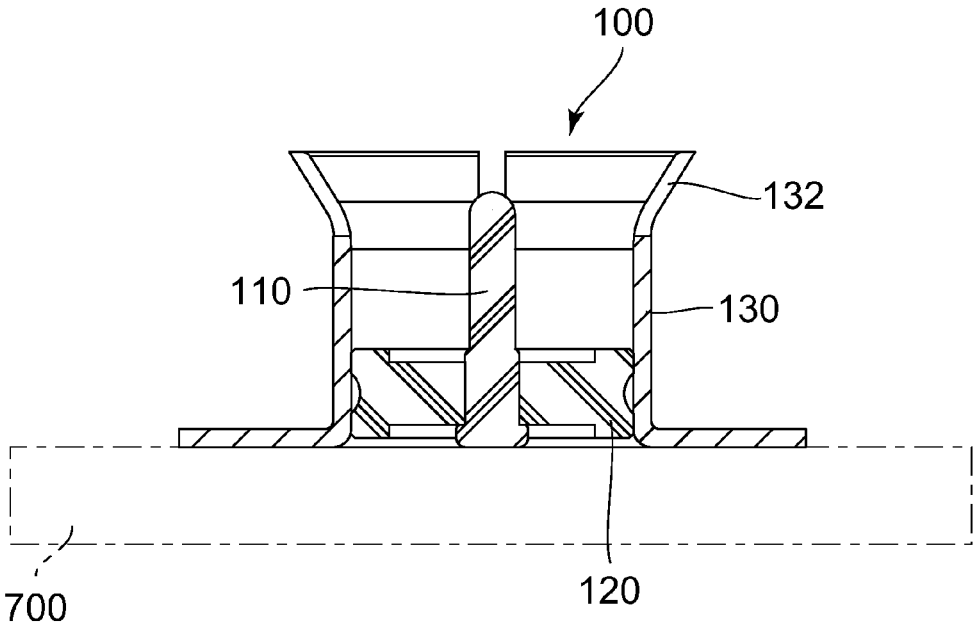
FIG. 5 is a cross-sectional view showing the first connector of FIG. 4.

As shown in FIGS. 4 and 5, the first connector 100 comprises a first center conductor 110, or a first terminal 110, a first holding member 120 and a first outer conductor 130. The first center conductor 110 extends in the axial direction. The first holding member 120 is made of insulator and holds the first center conductor 110. Since the first outer conductor 130 is attached to the first holding member 120 so as to cover the first holding member 120 in a radial direction, the first outer conductor 130 is positioned away from the first center conductor 110 in the radial direction. Thus, the first center conductor 110 and the first outer conductor 130 are separated and insulated from each other by the first holding member 120 in the radial direction. An end of the first outer conductor 130 is widened outward in the radial direction and forms a guide portion 132.

Figure 6:
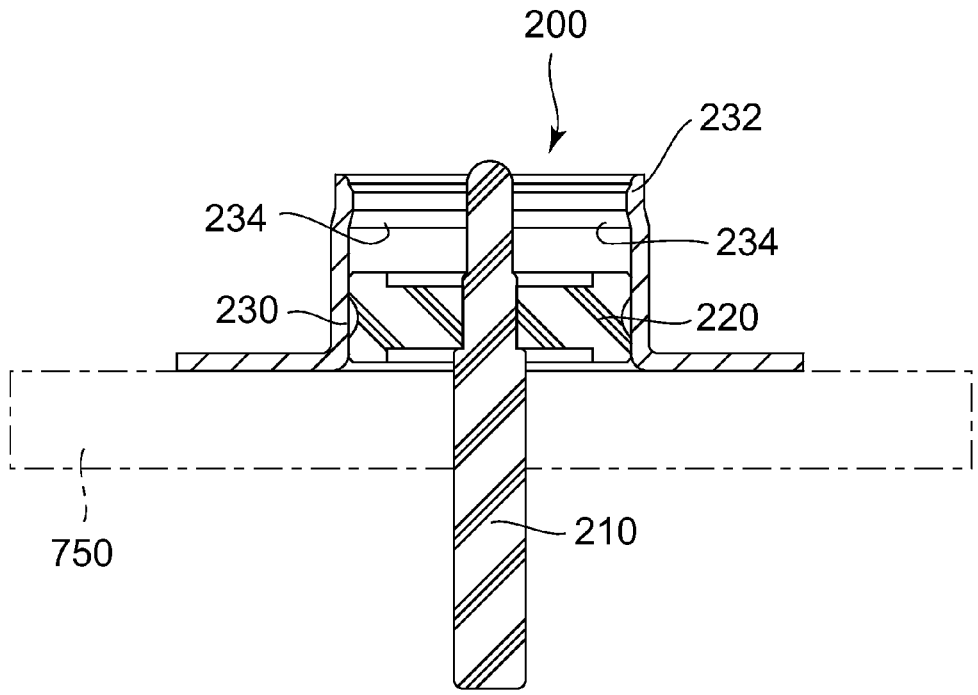
FIG. 6 is a cross-sectional view showing the second connector of FIG. 1.

As shown in FIGS. 1 and 6, the second connector 200 comprises a second center conductor 210, or a second terminal 210, a second holding member 220 and a second outer conductor 230. The second center conductor 210 extends in the axial direction. The second holding member 220 is made of insulator and holds the second center conductor 210. As shown in FIG. 6, the second center conductor 210 pierces the second holding member 220 to extend long in the axial direction. Since the second outer conductor 230 is attached to the second holding member 220 so as to cover the second holding member 220 in the radial direction, the second outer conductor 230 is positioned away from the second center conductor 210 in the radial direction. Thus, the second center conductor 210 and the second outer conductor 230 are separated and insulated from each other by the second holding member 220 in the radial direction.

As shown in FIG. 6, an end portion 232 of the second outer conductor 230 has a diameter smaller than that of a part thereof other than the end portion 232, and a difference surface is formed between the end portion 232 and the part thereof other than the end portion 232. The difference surface is used as a lock portion 234. As understood from FIGS. 5 and 6, the aforementioned lock portion 234 is not formed at the first outer conductor 130. Specifically, the lock portion 234 is formed only at the second outer conductor 230 among the first outer conductor 130 and the second outer conductor 230. On the other hand, as understood from FIGS. 5 and 6, the aforementioned guide portion 132 is formed only at the first outer conductor 130 and is not formed at the second outer conductor 230.

Figure 7:
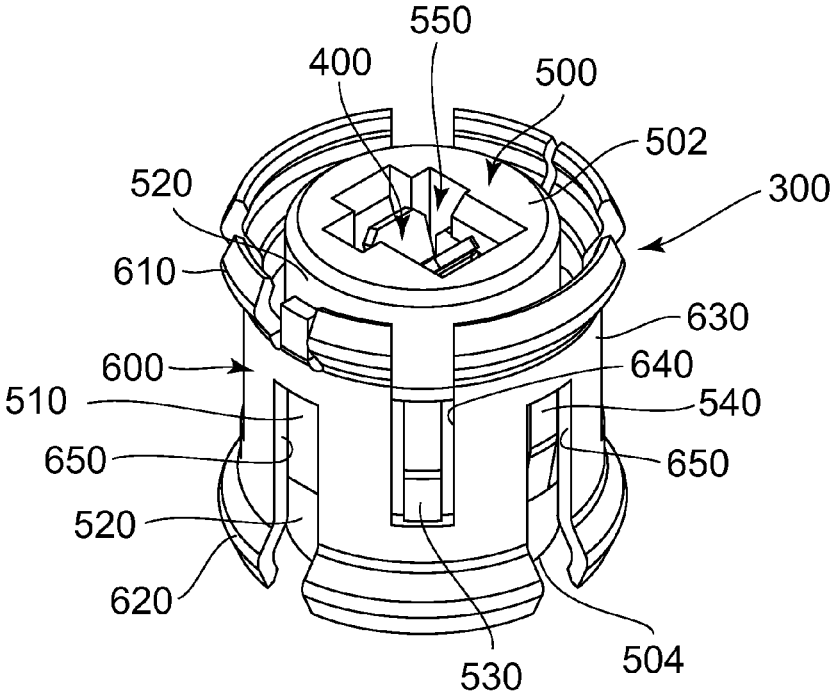
FIG. 7 is a perspective view showing the inter-connector of FIG. 1.

As shown in FIG. 7, the inter-connector 300 comprises a socket contact 400, a holding member 500 and an outer contact 600. The socket contact 400 is made of conductor. The holding member 500 is made of insulator. The outer contact 600 is made of conductor.

As shown in FIG. 3, the socket contact 400 is to be connected with the first center conductor 110, or the first terminal 110, and the second center conductor 210, or the second terminal 210, at opposite ends thereof in the axial direction, respectively.

Figure 9:
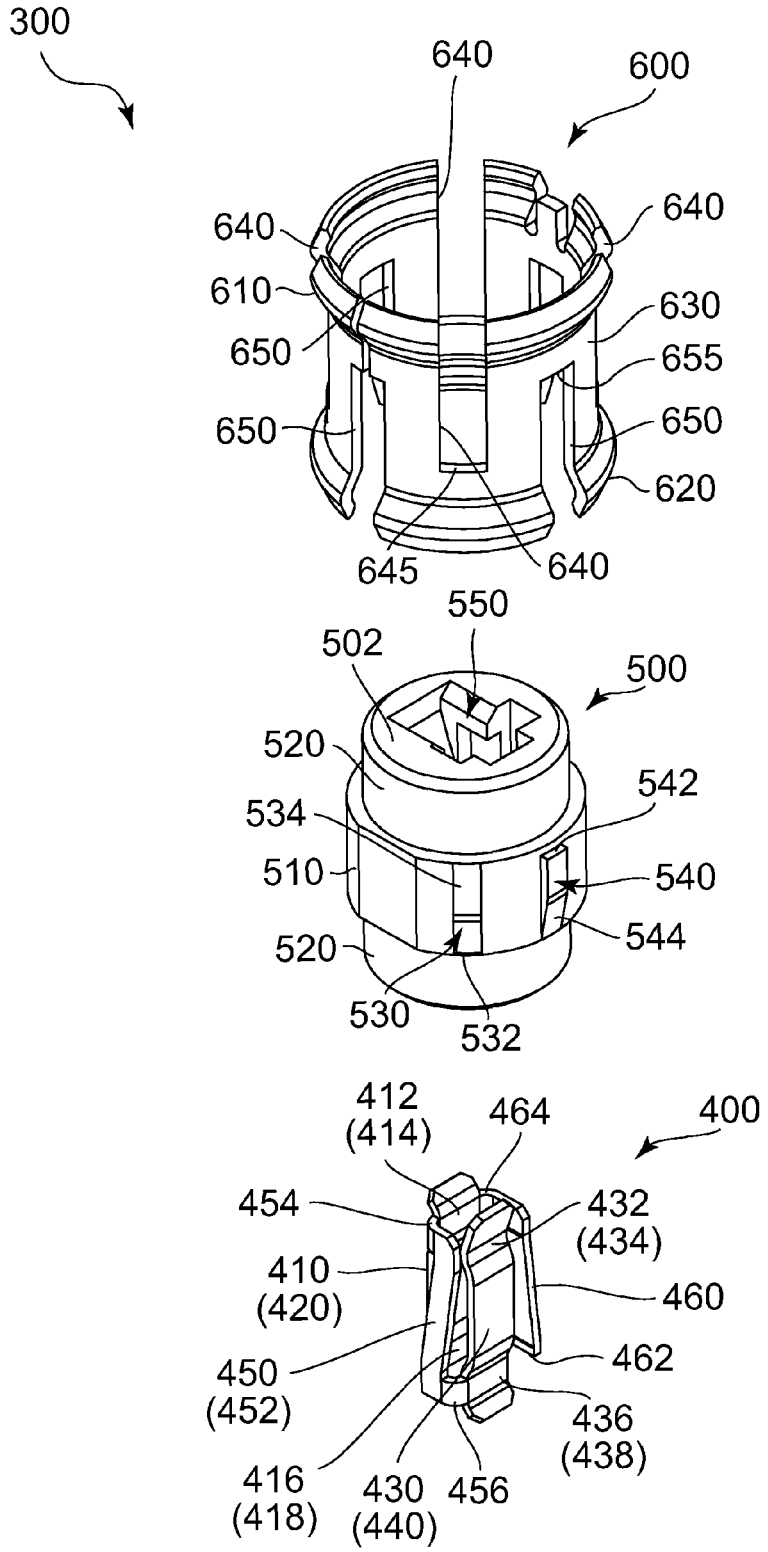
FIG. 9 is an exploded, perspective view showing the inter-connector of FIG. 7.
Figure 10:
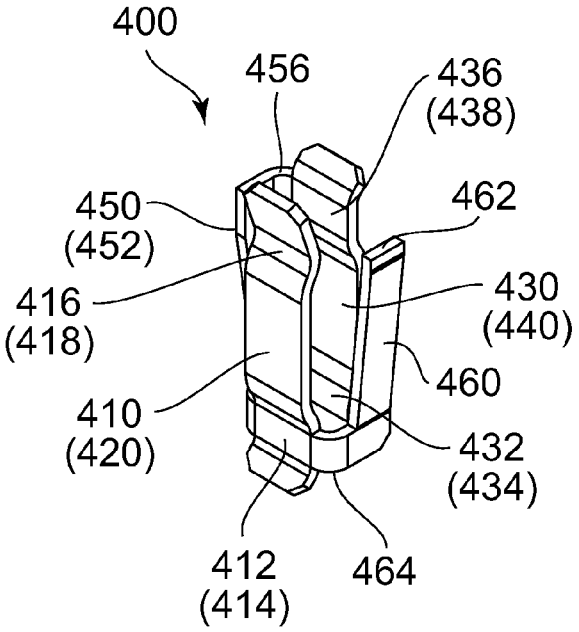
FIG. 10 is a perspective view showing a socket contact which is included in the inter-connector of FIG. 9.
Figure 11:
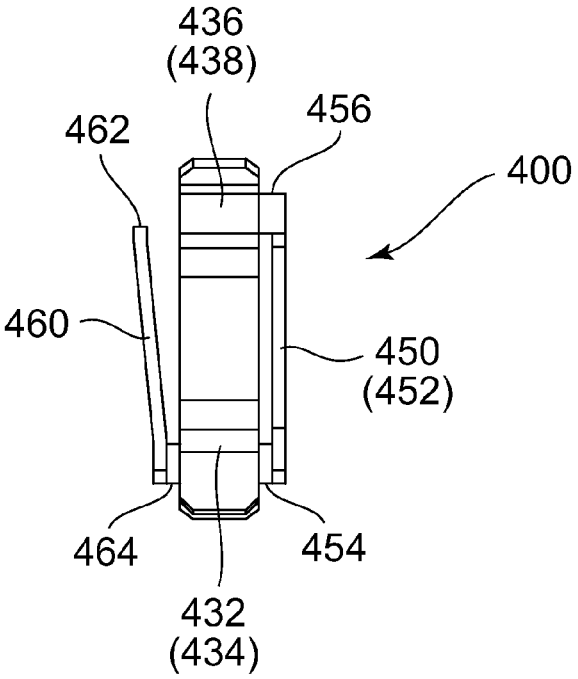
FIG. 11 is a side view showing the socket contact of FIG. 10.

With reference to FIGS. 9 to 11, the socket contact 400 is obtained by punching out and bending a single metal plate. The socket contact 400 has a first portion 410, a second portion 430, a coupling portion 450 and a lance 460.

As shown in FIG. 10, the first portion 410 has an inner first end 412, or a first end 412, an inner second end 416, or a second end 416, and a first spring portion 420. The inner first end 412 includes a first contact point 414 which is to be connected with the first center conductor 110 as shown in FIG. 3. The inner second end 416 includes a second contact point 418 which is to be connected with the second center conductor 210 as shown in FIG. 3. The first spring portion 420 is positioned between the first contact point 414 and the second contact point 418. The first spring portion 420 of the present embodiment extends essentially in the axial direction. Specifically, the first spring portion 420 of the present embodiment does not have a part which is folded back in the axial direction.

As shown in FIG. 9, the second portion 430 has an inner third end 432, or a third end 432, an inner fourth end 436, or a fourth end 436, and a second spring portion 440. The inner third end 432 includes a third contact point 434 which is to be connected with the first center conductor 110 as shown in FIG. 3. The inner fourth end 436 includes a fourth contact point 438 which is to be connected with the second center conductor 210 as shown in FIG. 3. The second spring portion 440 is positioned between the third contact point 434 and the fourth contact point 438. The second spring portion 440 of the present embodiment extends essentially in the axial direction. Specifically, the second spring portion 440 of the present embodiment does not have a part which is folded back in the axial direction.

As described above, each of the first spring portion 420 and the second spring portion 440 does not have a part which is folded back in the axial direction. Accordingly, when the socket contact 400 relays between the first center conductor 110 as shown in FIG. 3 and the second center conductor 210 as shown in FIG. 3, electric current does not flow back and forth but flows from one side of the connector device 10 to the other side thereof in the axial direction. Thus, high frequency characteristics can be prevented from being degraded when the socket contact 400 relays therebetween.

As shown in FIG. 9, the coupling portion 450 couples the inner first end 412 with the inner fourth end 436 so that the first portion 410 and the second portion 430 are arranged to face each other in a perpendicular direction perpendicular to the axial direction.

The coupling portion 450 of the present embodiment is directly coupled to neither the first spring portion 420 nor the second spring portion 440. Accordingly, the coupling portion 450 never impairs spring properties of the first spring portion 420 and the second spring portion 440.

As shown in FIG. 9, the coupling portion 450 has a base portion 452, a first bent portion 454, or a first shoulder portion 454, and a second bent portion 456. In addition, the coupling portion 450 has a Z-like shape when projected on a predetermined plane which is defined by the axial direction and the perpendicular direction. The base portion 452 extends in a direction intersecting with the axial direction in a plane parallel to the predetermined plane. The first bent portion 454 couples the inner first end 412 with the base portion 452, and the second bent portion 456 couples the inner fourth end 436 with the base portion 452. Specifically, the first bent portion 454 is formed on a first boundary portion between the inner first end 412 and the coupling portion 450, and the second bent portion 456 is formed on a third boundary portion between the inner fourth end 436 and the coupling portion 450.

As shown in FIG. 10, the lance 460 extends in the axial direction from the inner first end 412 toward a side of the inner second end 416 while extending outward. A second shoulder portion 464 is formed on a second boundary portion between the inner first end 412 and the lance 460. The second shoulder portion 464 is a portion which is formed through a bending process, similar to the first bent portion 454 and the second bent portion 456. The second shoulder portion 464 enables the lance 460 to be arranged to face the coupling portion 450 in a predetermined direction perpendicular to both the axial direction and the perpendicular direction. The lance 460 and the coupling portion 450 are positioned away from each other in the predetermined direction. In detail, each of the first portion 410 and the second portion 430 is positioned between the lance 460 and the coupling portion 450 in the predetermined direction.

As understood from FIG. 7, the holding member 500 accommodates the socket contact 400 and insulates the socket contact 400 and the outer contact 600 from each other. However, the present invention is not limited thereto. It is sufficient that the holding member 500 accommodates, at least in part, the socket contact 400.

Figure 12:
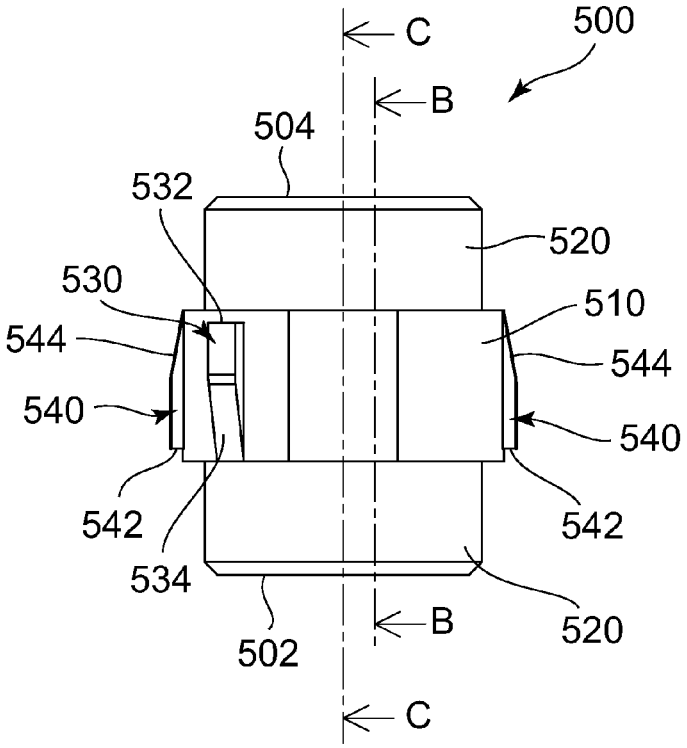
FIG. 12 is a side view showing a holding member which is included in the inter-connector of FIG. 9.
Figure 13:
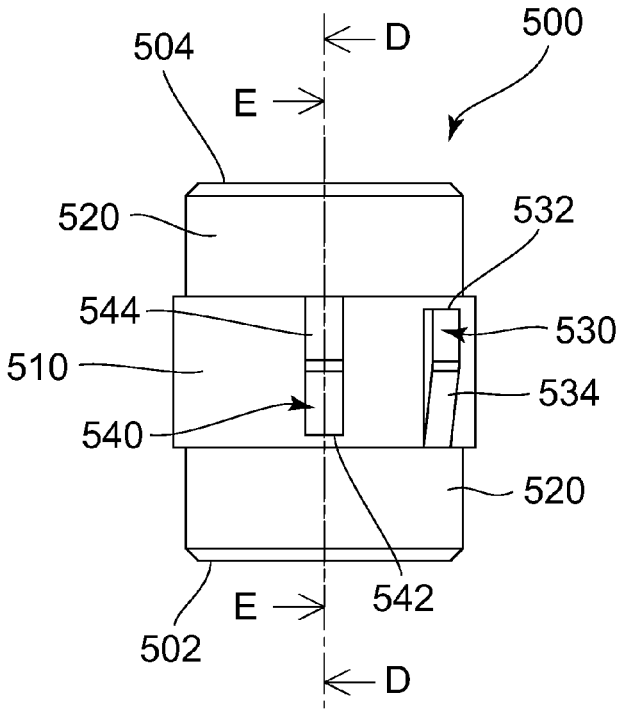
FIG. 13 is another side view showing the holding member of FIG. 12, wherein the another side view is rotated 90 degrees from the side view of FIG. 12.

As shown in FIGS. 9 and 12 to 16, the holding member 500 of the present embodiment has a larger diameter portion 510 and two smaller diameter portions 520 each of which is smaller than the larger diameter portion 510 in a plane perpendicular to the axial direction. The two smaller diameter portions 520 are positioned at opposite ends, respectively, of the larger diameter portion 510 in the axial direction. In other words, the larger diameter portion 510 is sandwiched between the two smaller diameter portions 520 in the axial direction. The larger diameter portion 510 is formed with two first protrusions 530 and two second protrusions 540. As best illustrated in FIGS. 12 and 13, each of the first protrusions 530 has a first facing surface 532 and a first slope 534. The first facing surface 532 is perpendicular to the axial direction, and the first slope 534 obliquely intersects with the axial direction. The holding member 500 has a holding member first end 502 and a holding member second end 504. The holding member second end 504 is positioned at one end of the holding member 500 in the axial direction, and the holding member first end 502 is positioned at the other end of the holding member 500 in the axial direction. The first facing surface 532 is positioned toward one end of the first protrusion 530 in the axial direction, and the first slope 534 is positioned toward the other end of the first protrusion 530 in the axial direction. In other words, the first facing surface 532 is nearer to the holding member second end 504 than the first slope 534, and the first slope 534 is nearer to the holding member first end 502 than the first facing surface 532. Each of the second protrusions 540 has a second facing surface 542 and a second slope 544. The second facing surface 542 is perpendicular to the axial direction, and the second slope 544 obliquely intersects with the axial direction. The second slope 544 is positioned toward one end of the second protrusion 540 in the axial direction, and the second facing surface 542 is positioned toward the other end of the second protrusion 540 in the axial direction. In other words, the second facing surface 542 is nearer to the holding member first end 502 than the second slope 544, and the second slope 544 is nearer to the holding member second end 504 than the second facing surface 542. As understood from the above explanation, in the axial direction, each of the first protrusions 530 is arranged in one direction, and each of the second protrusions 540 is arranged in another direction opposite to the one direction.

Figure 14:
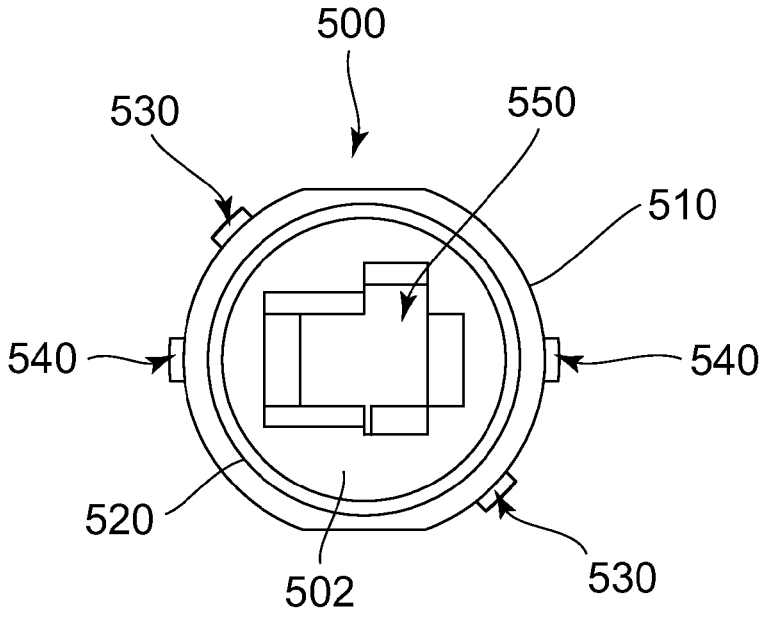
FIG. 14 is a view showing one end of the holding member of FIG. 12 in an axial direction.
Figure 15:
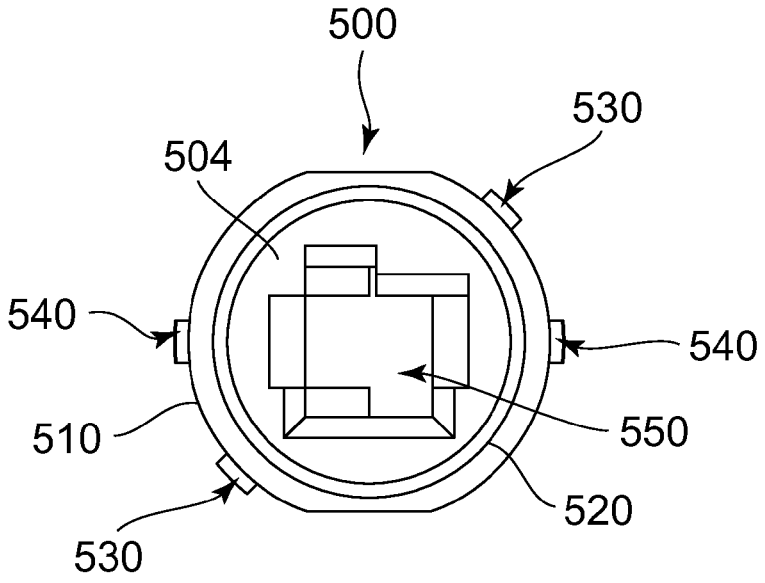
FIG. 15 is a view showing the other end of the holding member of FIG. 12 in the axial direction.
Figure 16:
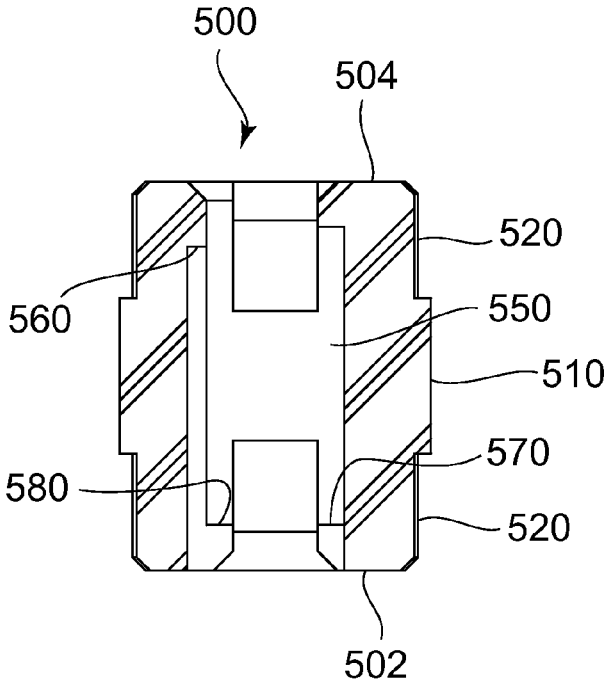
FIG. 16 is a cross-sectional view showing the holding member of FIG. 12, taken along line B-B.
Figure 17:
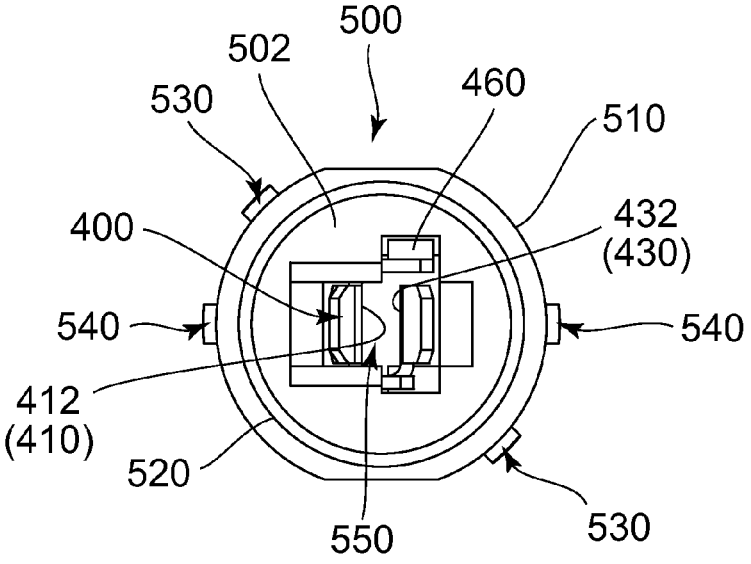
FIG. 17 is a view showing a structure consisting of the holding member of FIG. 14 and the socket contact of FIG. 10 which is accommodated therein.
Figure 18:
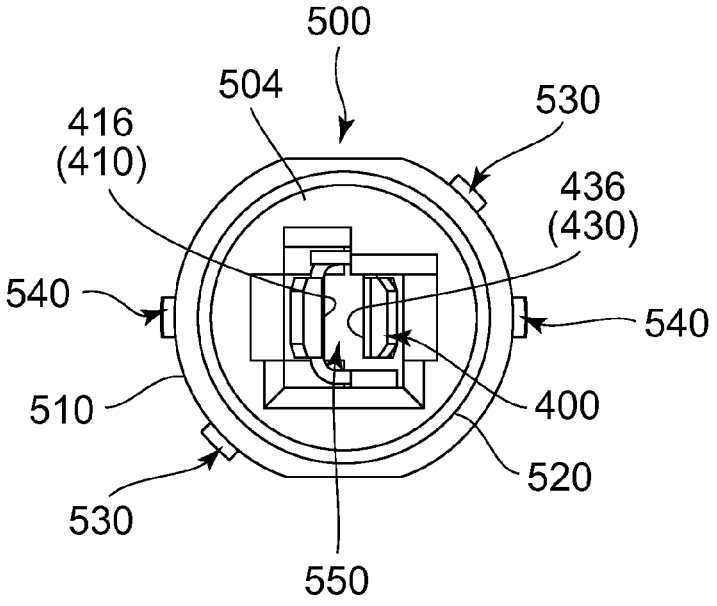
FIG. 18 is a view showing a structure consisting of the holding member of FIG. 15 and the socket contact of FIG. 10 which is accommodated therein.
Figure 19:
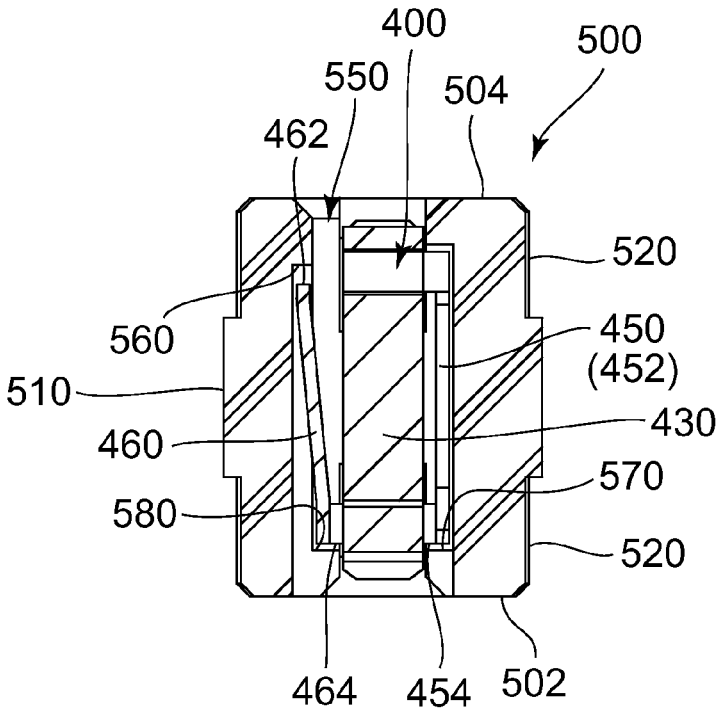
FIG. 19 is a cross-sectional view showing the structure of FIG. 17, taken along line B-B of FIG. 12.
Figure 20:
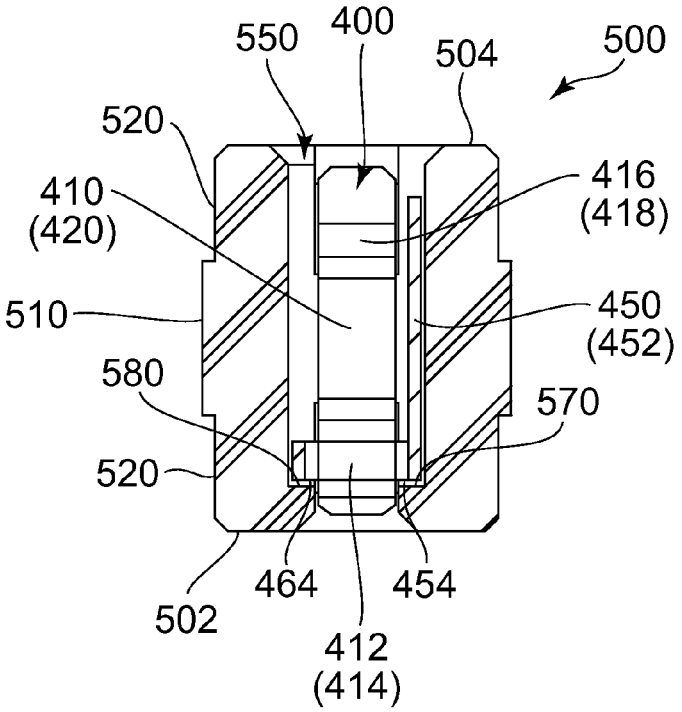
FIG. 20 is a cross-sectional view showing the structure of FIG. 17, taken along line C-C of FIG. 12.
Figure 21:
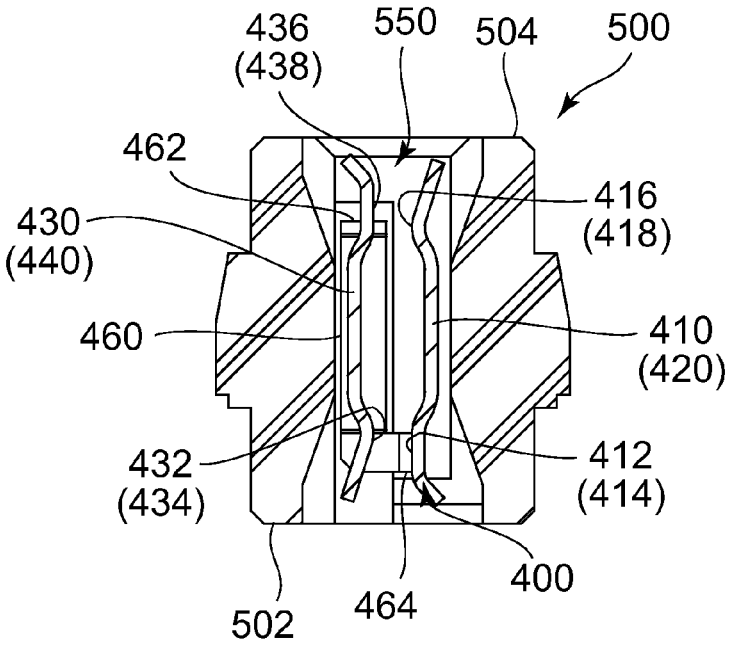
FIG. 21 is a cross-sectional view showing the structure of FIG. 17, taken along line D-D of FIG. 13.
Figure 22:
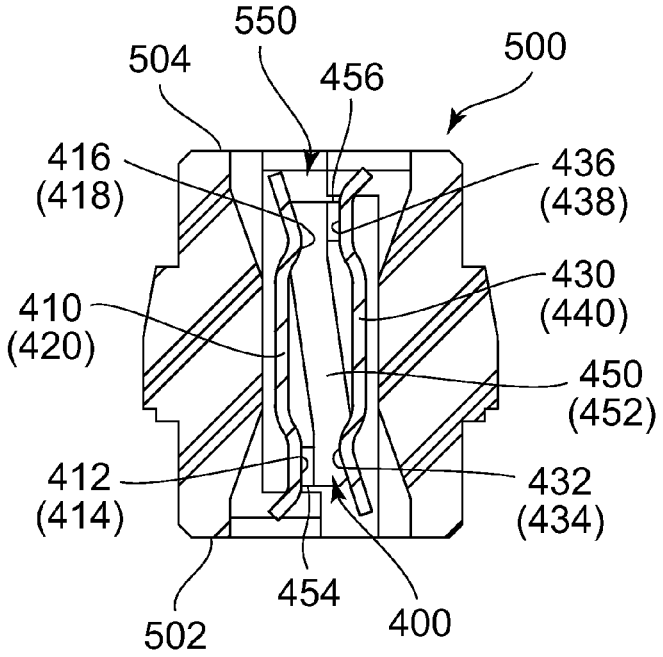
FIG. 22 is a cross-sectional view showing the structure of FIG. 17, taken along line E-E of FIG. 13.

As shown in FIGS. 14 to 16, the holding member 500 is formed with a holding hole 550. The holding hole 550 pierces the holding member 500 in the axial direction. As shown in FIGS. 17 to 22, the socket contact 400 is received within and held by the holding hole 550. Specifically, the socket contact 400 is inserted within the holding hole 550 from the holding member second end 504 of the holding member 500 toward the holding member first end 502. In detail, the inner first end 412 and the inner third end 432 are inserted within the holding hole 550 before the inner second end 416 and the inner fourth end 436 are inserted therewithin. When the socket contact 400 is inserted within the holding hole 550, the lance 460 is temporarily bent and then restores to its original shape in the holding hole 550 so that the lance 460 faces an inside of the holding member 500 as described below.

As shown in FIG. 16, the holding member 500 is formed with an abutment portion 560, a first receiving portion 570 and a second receiving portion 580 which are positioned inside of the holding member 500, namely, in the holding hole 550. Each of the abutment portion 560, the first receiving portion 570 and the second receiving portion 580 is perpendicular to the axial direction. As understood from FIGS. 16 and 19, the abutment portion 560 faces an end 462 of the lance 460 in the axial direction. Similarly, the first receiving portion 570 and the second receiving portion 580 face the first shoulder portion 454, or the first bent portion 454, and the second shoulder portion 464 in the axial direction, respectively, and are able to receive the first shoulder portion 454 and the second shoulder portion 464 in the axial direction, respectively. As understood from FIG. 19, the holding member 500 and the socket contact 400 of the present embodiment is designed so that the end 462 of the lance 460 is positioned away from the abutment portion 560 in the axial direction when the first shoulder portion 454 and the second shoulder portion 464 are brought into contact with the first receiving portion 570 and the second receiving portion 580, respectively. Accordingly, the socket contact 400 is movable in the axial direction within the holding member 500. Specifically, the socket contact 400 is floatingly supported by the holding member 500 so as to be movable in the axial direction. In the present embodiment, the end 462 of the lance 460 faces the abutment portion 560 while the first shoulder portion 454 and the second shoulder portion 464 face the first receiving portion 570 and the second receiving portion 580, respectively. Accordingly, the socket contact 400 held by the holding hole 550 is prevented from being removed outside the holding hole 550.

As shown in FIG. 3, the outer contact 600 is to be connected with the first outer conductor 130 and the second outer conductor 230.

Figure 23:
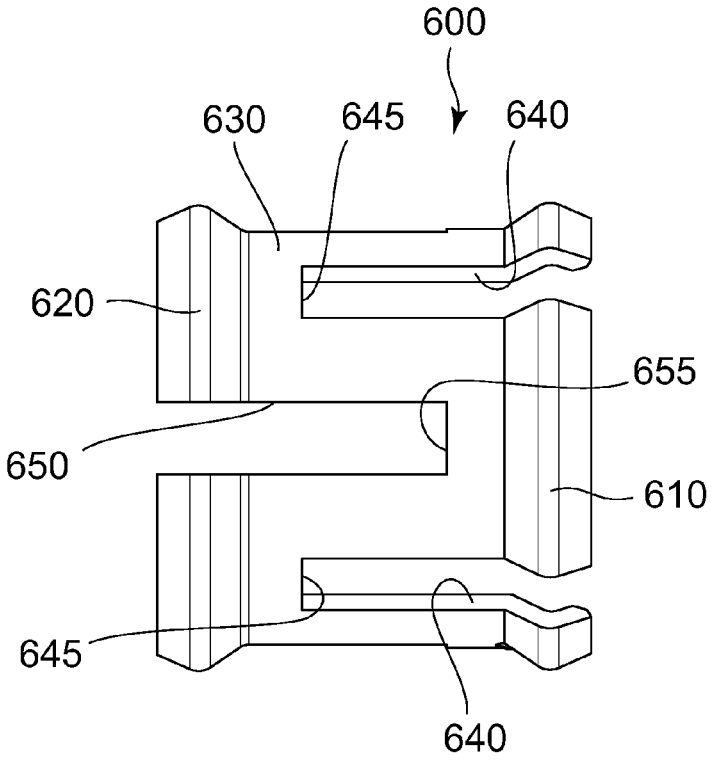
FIG. 23 is a side view showing an outer contact which is included in the inter-connector of FIG. 9.
Figure 24:
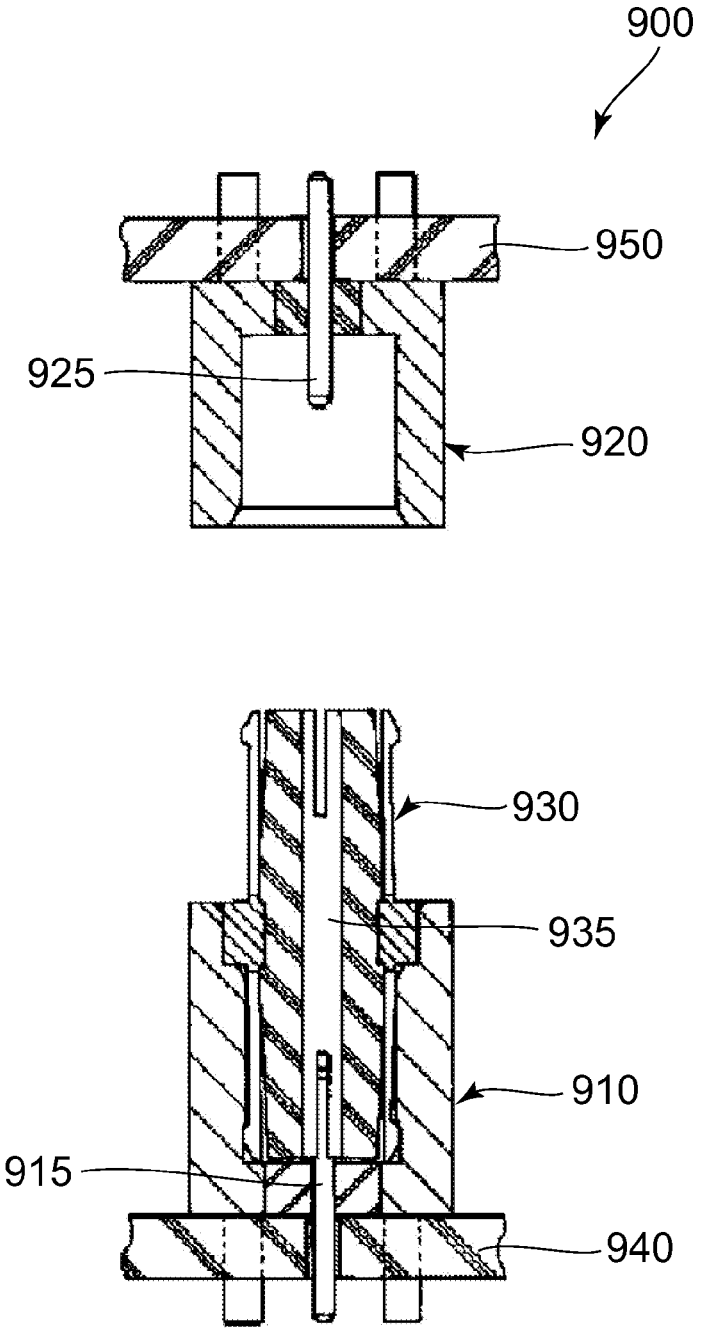
FIG. 24 PRIOR ART
FIG. 24 is a cross-sectional view showing a connector device of Patent Document 1.

As shown in FIGS. 9 and 23, the outer contact 600 has an outer first end 610, an outer second end 620 and an outer main portion 630. The outer first end 610 and the outer second end 620 are positioned away from each other in the axial direction. The outer main portion 630 couples the outer first end 610 with the outer second end 620. As shown in FIG. 3, each of the outer first end 610 and the outer second end 620 has a dog-leg like cross-section which projects outward. The outer first end 610 and the outer second end 620 are to be connected with the first outer conductor 130 and the second outer conductor 230, respectively.

As shown in FIGS. 9 and 23, the outer contact 600 is formed with a plurality of first slits 640 and a plurality of second slits 650. Each of the first slits 640 extends from the outer first end 610 toward the outer second end 620 while not reaching the outer second end 620. Each of the second slits 650 extends from the outer second end 620 toward the outer first end 610 while not reaching the outer first end 610. An end of each of the first slits 640 which forms an end edge thereof in the axial direction, namely, the end thereof near to the outer second end 620, functions as a first stopper 645 as described later. Similarly, an end of each of the second slits 650 which forms an end edge thereof in the axial direction, namely, the end thereof near to the outer first end 610, functions as a second stopper 655 as described later.

Portions each of which is sandwiched between the first slits 640 adjacent to each other function as first spring parts, respectively, which resiliently support the outer first end 610. In addition, portions each of which is sandwiched between the second slits 650 adjacent to each other function as second spring parts, respectively, which resiliently support the outer second end 620. The aforementioned first and second spring parts enable the outer first end 610 and the outer second end 620 to be movable in the radial direction. Specifically, the outer first end 610 and the outer second end 620 are resiliently deformable.

In the present embodiment, the number of the first slits 640 is equal to the number of the second slits 650, and the first slits 640 and the second slits 650 are alternately arranged in a circumferential direction around the axial direction. The first slits 640 are positioned at first positions, respectively, in the axial direction. The second slits 650 are positioned at second positions, respectively, in the axial direction. Each of the first positions and each of the second positions overlap with each other. As a result, the first spring parts which support the outer first end 610 are formed with parts of the second slits 650, respectively, and the second spring parts which support the outer second end 620 are formed with parts of the first slits 640, respectively. The aforementioned structure enables the outer contact 600 to have a reduced size in the axial direction, while enabling it to be formed with relatively long slits to comprise springs each of which has a long spring length. Specifically, in the present embodiment, a size of each of the first slits 640 in the axial direction is larger than half of another size of the outer contact 600 in the axial direction, and a size of each of the second slits 650 in the axial direction is larger than half of another size of the outer contact 600 in the axial direction. Accordingly, even if the outer contact 600 has a reduced size, each of the first and second spring parts can have an increased spring length.

The outer contact 600 having the aforementioned structure is attached on an outer circumference of the holding member 500 by inserting the holding member 500 into the outer contact 600 so that the holding member first end 502 is positioned toward the outer first end 610 while the holding member second end 504 is positioned toward the outer second end 620. Since the first slopes 534 of the first protrusions 530 and the second slopes 544 of the second protrusions 540 are provided on the holding member 500, the holding member 500 can be easily inserted into the outer contact 600 upon the aforementioned attachment. As a result of the aforementioned attachment, each of the first protrusions 530 is received in a different one of the first slits 640 while each of the second protrusions 540 is received in a different one of the second slits 650.

Figure 8:
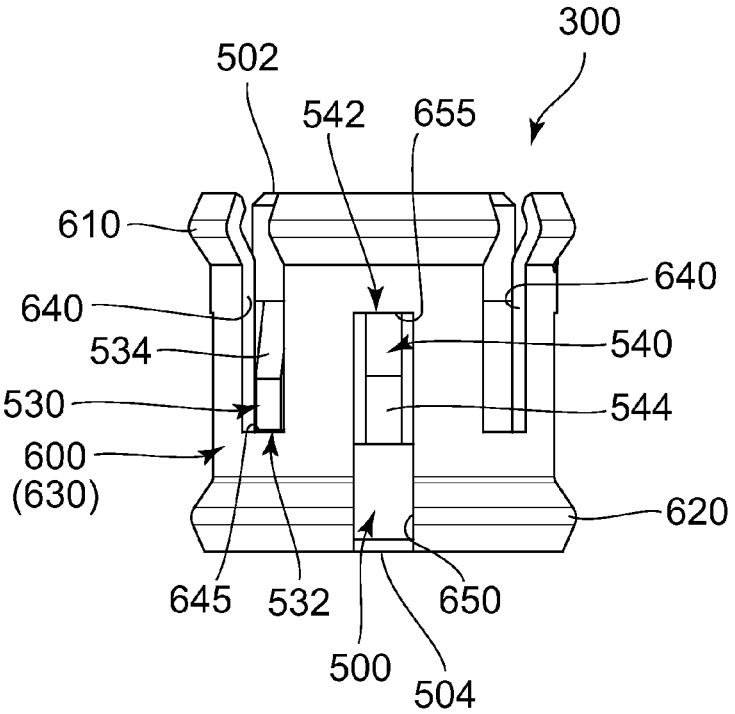
FIG. 8 is a side view showing the inter-connector of FIG. 7.

In detail, with reference to FIG. 8, each of the first facing surfaces 532 of the first protrusions 530 faces a different one of the first stoppers 645 in the axial direction while each of the second facing surfaces 542 of the second protrusions 540 faces a different one of the second stoppers 655 in the axial direction. In addition, each of the first facing surfaces 532 is positioned between the first slope 534 and the different one of the first stoppers 645 in the axial direction while each of the second facing surfaces 542 is positioned between the second slope 544 and the different one of the second stoppers 655 in the axial direction. Furthermore, each of the first stoppers 645 is positioned between the first slit 640 and the outer second end 620 while each of the second stoppers 655 is positioned between the second slit 650 and the outer first end 610.

As shown in FIG. 9, the smaller diameter portions 520 are provided at the opposite ends, respectively, of the larger diameter portion 510 in the axial direction. Thus, the interconnector 300 is formed with a first space and a second space as shown in FIG. 7, wherein the first space is positioned inside of the outer first end 610 in the radial direction and the second space is positioned inside of the outer second end 620 in the radial direction. Accordingly, the outer first end 610 and the outer second end 620 are movable inward in the radial direction.

As understood from FIG. 2, in a state where the inter-connector 300 is mated with the second connector 200, the outer main portion 630 of the outer contact 600 is positioned away from the second outer conductor 230 in the radial direction. Accordingly, the inter-connector 300 is movable in a plane perpendicular to the axial direction by using resilience of the outer contact 600. Specifically, the inter-connector 300 is floatingly supported by the second connector 200. When the first connector 100 is mated with the inter-connector 300 which is floatingly supported by the second connector 200 as described above, the outer first end 610 is guided by the guide portion 132 to be properly received within the first outer conductor 130. As understood from FIG. 3, when the first circuit board 700 and the second circuit board 750 face each other, the first connector 100 and the inter-connector 300 can be properly mated with each other without visual inspection of their mating position even if the first connector 100 and the inter-connector 300 are slightly misaligned with each other.

As shown in FIG. 3, in a state where the first connector 100 and the second connector 200 are connected with each other through the inter-connector 300, the outer main portion 630 of the outer contact 600 is positioned away from the first outer conductor 130 in the radial direction. As understood from FIG. 3, the first outer conductor 130 of the first connector 100 and the outer contact 600 of the inter-connector 300 are connected with each other only at the outer first end 610, and the second outer conductor 230 of the second connector 200 and the outer contact 600 of the inter-connector 300 are connected with each other only at the outer second end 620.

As shown in FIG. 3, the guide portion 132 is provided so as not to be directly brought into contact with the second outer conductor 230 in a state where the first connector 100 and the second connector 200 are connected with each other through the inter-connector 300.

As shown in FIG. 3, the outer second end 620 is locked by the lock portion 234 of the second outer conductor 230 in a state where the inter-connector 300 is mated with the second connector 200. On the other hand, as previously described, the first connector 100 is not provided with a portion similar to the lock portion 234. Accordingly, when the first circuit board 700 and the second circuit board 750 are moved away from each other in a state where the first connector 100 fixed to the first circuit board 700 and the second connector 200 fixed to the second circuit board 750 are connected with each other through the inter-connector 300, the mating of the inter-connector 300 with the second connector 200 is maintained while the first connector 100 is removed from the inter-connector 300. Meanwhile, each of the second stoppers 655 as shown in FIG. 8 is brought into abutment with a different one of the second facing surfaces 542 so that the holding member 500 is prevented from being removed from the outer contact 600.

While the present invention has been described with specific embodiments, the present invention is not limited to the aforementioned embodiments. The present invention can be variously modified. For example, the guide portion 132 shown in FIG. 1 is formed as follows. Incisions are made at the end of the first outer conductor 130 and the end thereof is widened outward to form the guide portion 132. However, the present invention is not limited thereto. The first outer conductor 130 may be formed with a guide portion having no incision by one of the following methods; a metal plate is shear-cut to form an end thereof and is cylindrically rolled, or a metal plate is cylindrically rolled without shearing it and an end of the rolled metal plate is expanded outward.

The present application is based on a Japanese patent application of JP 2014-231492 filed before the Japan Patent Office on Nov. 14, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A socket contact connectable with a first terminal and a second terminal at opposite ends thereof in an axial direction, respectively, the socket contact comprising:

a first portion having a first end, a second end and a first spring portion, the first end being positioned at a vicinity of an end of the first portion in a first orientation of the axial direction, the first end including a first contact point which is to be connected to the first terminal, the second end including a second contact point which is to be connected to the second terminal, the first spring portion being positioned between the first contact point and the second contact point;

a second portion having a third end, a fourth end and a second spring portion, the third end including a third contact point which is to be connected to the first terminal, the fourth end being positioned at a vicinity of an end of the second portion in a second orientation opposite to the first orientation, the fourth end including a fourth contact point which is to be connected to the second terminal, the second spring portion being positioned between the third contact point and the fourth contact point; and a coupling portion only coupling the first end with the fourth end.

2. The socket contact as recited in claim 1, wherein each of the first spring portion and the second spring portion does not have a part which is folded back in the axial direction.

3. The socket contact as recited in claim 1, wherein the first portion and the second portion are arranged to face each other in a perpendicular direction perpendicular to the axial direction.

4. The socket contact as recited in claim 3, wherein the coupling portion has a Z-like shape when projected on a predetermined plane which is defined by the axial direction and the perpendicular direction.

5. The socket contact as recited in claim 4, wherein the coupling portion has a base portion which extends in a direction intersecting with the axial direction in a plane parallel to the predetermined plane.

6. An inter-connector comprising the socket contact as recited in claim 1 and a holding member which accommodates, at least in part, the socket contact to hold the socket contact.

7. The inter-connector as recited in claim 6, wherein:

the socket contact is formed with a lance which extends from the first end toward a side of the second end;

an abutment portion is formed inside of the holding member;

the lance has an end in the axial direction; and the abutment portion faces the end of the lance in the axial direction.

8. An inter-connector comprising:

a socket contact and a holding member which accommodates, at least in part, the socket contact to hold the socket contact, wherein:

the socket contact is connectable with a first terminal and a second terminal at opposite ends thereof in an axial direction, respectively;

the socket contact comprises:

a first portion having a first end, a second end and a first spring portion, the first end including a first contact point which is to be connected to the first terminal, the second end including a second contact point which is to be connected to the second terminal, the first spring portion being positioned between the first contact point and the second contact point;

a second portion having a third end, a fourth end and a second spring portion, the third end including a third contact point which is to be connected to the first terminal, the fourth end including a fourth contact point which is to be connected to the second terminal, the second spring portion being positioned between the third contact point and the fourth contact point; and a coupling portion coupling the first end with the fourth end;

the socket contact is formed with a lance which extends from the first end toward a side of the second end;

an abutment portion is formed inside of the holding member;

the lance has an end in the axial direction;

the abutment portion faces the end of the lance in the axial direction; and each of the first portion and the second portion is positioned between the lance and the coupling portion.

9. An inter-connector comprising:

a socket contact and a holding member which accommodates, at least in part, the socket contact to hold the socket contact;

wherein:

the socket contact is connectable with a first terminal and a second terminal at opposite ends thereof in an axial direction, respectively;

the socket contact comprises:

a first portion having a first end, a second end and a first spring portion, the first end including a first contact point which is to be connected to the first terminal, the second end including a second contact point which is to be connected to the second terminal, the first spring portion being positioned between the first contact point and the second contact point;

a second portion having a third end, a fourth end and a second spring portion, the third end including a third contact point which is to be connected to the first terminal, the fourth end including a fourth contact point which is to be connected to the second terminal, the second spring portion being positioned between the third contact point and the fourth contact point; and a coupling portion coupling the first end with the fourth end;

the socket contact is formed with a lance which extends from the first end toward a side of the second end;

an abutment portion is formed inside of the holding member;

the lance has an end in the axial direction;

the abutment portion faces the end of the lance in the axial direction;

the socket contact has a first shoulder portion and a second shoulder portion;

the first shoulder portion is formed on a first boundary portion between the first end and the coupling portion;

the second shoulder portion is formed on a second boundary portion between the first end and the lance;

the holding member is formed with a first receiving portion and a second receiving portion which are positioned inside of the holding member and are able to receive the first shoulder portion and the second shoulder portion in the axial direction, respectively; and when the first shoulder portion and the second shoulder portion are brought into contact with the first receiving portion and the second receiving portion, respectively, the end of the lance is positioned away from the abutment portion in the axial direction so that the socket contact is movable in the axial direction within the holding member.

10. A connector device comprising an inter-connector, a first connector and a second connector, wherein:

the inter-connector comprises a socket contact and a holding member which accommodates, at least in part, the socket contact to hold the socket contact;

the socket contact is connectable with a first terminal and a second terminal at opposite ends thereof in an axial direction, respectively;

the socket contact comprises:

a first portion having a first end, a second end and a first spring portion, the first end including a first contact point which is to be connected to the first terminal, the second end including a second contact point which is to be connected to the second terminal, the first spring portion being positioned between the first contact point and the second contact point;

a second portion having a third end, a fourth end and a second spring portion, the third end including a third contact point which is to be connected to the first terminal, the fourth end including a fourth contact point which is to be connected to the second terminal, the second spring portion being positioned between the third contact point and the fourth contact point; and a coupling portion coupling the first end with the fourth end;

the first connector comprises the first terminal and a first outer conductor;

the first terminal functions as a first center conductor;

the first outer conductor is positioned away from the first center conductor in a radial direction perpendicular the axial direction;

the second connector comprises the second terminal and a second outer conductor;

the second terminal functions as a second center conductor;

the second outer conductor is positioned away from the second center conductor in the radial direction;

the inter-connector is to be mated with the first connector and the second connector at opposite ends thereof in the axial direction, respectively;

the inter-connector further comprises an outer contact;

the holding member insulates the socket contact and the outer contact from each other;

the outer contact has an outer first end, an outer second end and an outer main portion;

the outer first end and the outer second end are positioned away from each other in the axial direction;

the outer first end and the outer second end are to be connected with the first outer conductor and the second outer conductor, respectively;

the outer main portion couples the outer first end with the outer second end;

the outer contact is formed with a plurality of first slits and a plurality of second slits;

each of the first slits extends from the outer first end toward the outer second end while not reaching the outer second end;

each of the second slits extends from the outer second end toward the outer first end while not reaching the outer first end;

the first slits and the second slits are alternately arranged in a circumferential direction around the axial direction;

the first slits are positioned at first positions, respectively, in the axial direction;

the second slits are positioned at second positions, respectively, in the axial direction; and each of the first positions and each of the second positions overlap with each other.

11. The connector device as recited in claim 10, wherein the first slits is equal in number to the second slits.

12. The connector device as recited in claim 10, wherein:

the outer contact is provided with a first stopper and a second stopper;

the first stopper is positioned between the first slits and the outer second end;

the second stopper is positioned between the second slits and the outer first end;

the holding member is formed with at least one first protrusion and at least one second protrusion;

the at least one first protrusion is received in at least one of the first slits;

the at least one second protrusion is received in at least one of the second slits;

the first protrusion has a first facing surface which faces the first stopper in the axial direction; and the second protrusion has a second facing surface which faces the second stopper in the axial direction.

13. The connector device as recited in claim 12, wherein:

the first protrusion further has a first slope which obliquely intersects with the axial direction;

the first facing surface is positioned between the first slope and the first stopper in the axial direction;

the second protrusion further has a second slope which obliquely intersects with the axial direction; and the second facing surface is positioned between the second slope and the second stopper in the axial direction.

14. The connector device as recited in claim 12, wherein:

only the second outer conductor among the first outer conductor and the second outer conductor is formed with a lock portion which locks the outer second end;

the lock portion locks the outer second end so that the inter-connector is held by the second connector; and when the first connector is removed from the inter-connector, the second stopper and the second facing surface are brought into abutment with each other so that the holding member is prevented from being removed from the outer contact.

15. The connector device as recited in claim 10, wherein the outer main portion of the outer contact is positioned away from the first outer conductor and the second outer conductor in the radial direction.

16. The connector device as recited in claim 15, wherein the first outer conductor is formed with a guide portion which guides the outer first end of the outer contact when the first connector and the inter-connector are mated with each other.

17. The connector device as recited in claim 16, wherein the guide portion is provided so as not to be directly brought into contact with the second outer conductor in a state where the first connector and the second connector are connected with each other through the inter-connector.

18. The connector device as recited in claim 10, wherein:

in the axial direction, a size of each of the first slits is larger than half of another size of the outer contact; and in the axial direction, a size of each of the second slits is larger than half of another size of the outer contact.

19. The connector device as recited in claim 10, wherein:

the first connector is to be fixed to a first circuit board; and the second connector is to be fixed to a second circuit board which is different from the first circuit board.

* * * * *